219-121
10/7/80 XR 4,226,266

United States Patent [19]
Guigan

[11] 4,226,266
[45] Oct. 7, 1980

[54] PROCESS AND DEVICE FOR DISPENSING A PREDETERMINED AMOUNT OF A LIQUID SUBSTANCE INTO A VESSEL

[76] Inventor: Jean Guigan, 9, rue Jean Mermoz, 75008 Paris, France

[21] Appl. No.: 46,965

[22] Filed: Jun. 8, 1979

[30] Foreign Application Priority Data

Jun. 23, 1978 [FR] France ..... 78 18831

[51] Int. Cl.[3] ..... B65B 3/26
[52] U.S. Cl. ..... 141/11; 141/67; 141/82; 83/15; 219/121 L; 222/146 C
[58] Field of Search ..... 222/52, 1, 590, 70, 222/71, 146 R, 146 C; 219/121 L, 121 LM; 83/15, 170; 141/1, 11, 82, 69, 67

[56] References Cited

U.S. PATENT DOCUMENTS 4,015,440 4/1972 Pietrucha et al. ..... 141/82

*Primary Examiner*—Houston S. Bell, Jr.
*Attorney, Agent, or Firm*—Sughrue, Rothwell, Mion, Zinn and Macpeak

[57] ABSTRACT

The invention relates to a process and a device for dispensing a predetermined amount of a liquid substance into a vessel.

The device comprises a pipette (1) provided with a piston (5) for pumping of the liquid substance, a sleeve (19) for cooling the lower tube (2) of the pipette and means (23,24,25) for cutting the thread (40) of frozen substance leaving the calibrated tube when pressure is applied on the piston.

Application to measuring out of reagents in laboratory analyses.

13 Claims, 2 Drawing Figures

PROCESS AND DEVICE FOR DISPENSING A PREDETERMINED AMOUNT OF A LIQUID SUBSTANCE INTO A VESSEL

FIELD OF THE INVENTION

The present invention relates to a process and device for dispensing a predetermined amount of a liquid substance into a vessel.

BACKGROUND OF THE INVENTION

When laboratory analyses are being carried out it is known that it is often necessary to provide a predetermined amount of a liquid substance, such as a reagent, in a small vessel. To achieve this a graduated pipette is generally used with the aid of which a certain amount of the reagent is drawn off by suction and a portion of the amount taken is allowed to flow by gravity into the vessel, the volume and the amount of the reagent dispensed in this way being determined by the level difference which is read from the graduation of the pipette.

When, however, the amount of reagent is very small this method has the disadvantage of lacking in accuracy.

More precisely, as a result of the capillarity phenomenon in the calibrated tube, the amount which is dispensed into the vessel can only be determined with a degree of accuracy which corresponds to the volume of one drop, and this volume is not negligible with respect to the volume of the measured amount.

Moreover, the method described above is time-consuming, requires a certain amount of skill and does not readily lend itself to being used in an automatic line. It is consequently of little practical use when a large number of measured amounts have to be prepared.

Preferred embodiments of the present invention overcome these disadvantages and provide an accurate process for dispensing a very small measured amount of a liquid substance into a vessel, this process being able to be readily applied to an automatic filling device. The present invention can naturally be used also for measuring out somewhat larger quantities.

SUMMARY OF THE INVENTION

The present invention provides a process for dispensing a predetermined amount of a liquid substance into a vessel. The process consists of causing a portion of this substance to pass into a tubular part which is arranged vertically above the vessel, cooling a lower portion of the tubular part, this lower portion being a calibrated tube, applying a downwardly directed vertical pressure on the upper surface of the substance which has been taken up in the tubular part, cooling being sufficiently intense for a continuous vertical thread of frozen substance to form, under the influence of the said pressure, below the calibrated tube and cutting the thread in such a way that a detached portion of predetermined length which is removed from the thread is carried by gravity to the vessel, whereby this detached portion constitutes, after regaining the liquid state, said predetermined dispensed amount.

The present invention also provides a device for dispensing a predetermined amount of a liquid substance into a vessel, comprising a tubular part which is arranged vertically above the vessel and means for causing a portion of this substance to pass into the tubular part, wherein the lower portion of the tubular part comprises a calibrated tube and the device further comprises:

means for cooling the calibrated tube, means for applying a downwardly directed vertical pressure on the upper level of the substance received by the tube, these means operating simultaneously with the said means for cooling in order to form a continuous vertical thread of frozen substance below the calibrated tube, and means for cutting the thread so as to separate a detached portion of the thread having a predetermined length, whereby this detached portion, which is received by gravity in the vessel, constitutes, after regaining the liquid state, the said predetermined dispensed amount.

An embodiment of the present invention is described below by way of example, with reference to the attached drawing.

DESCIPTION OF THE PREFERRED EMBODIMENT

Figure 1:
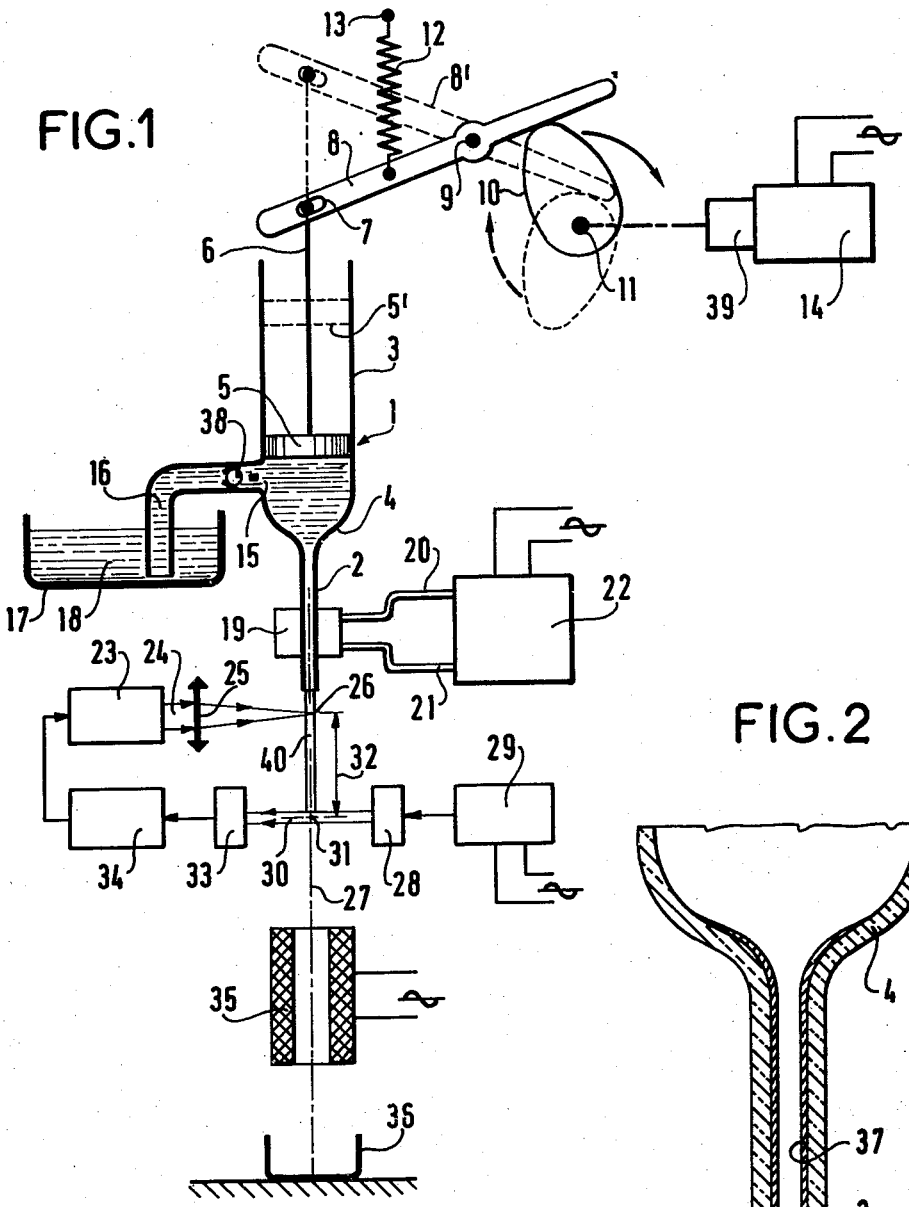
FIG. 1 is a diagrammatic representation of one embodiment of a device in accordance with the invention.

FIG. 1 shows a tubular part 1, in glass for example, essentially composed of a calibrated tube 2, having an internal cross section of one square millimeter for example, surmounted by a filling tube 3, having a larger diameter. The two tubes are aligned on the same vertical axis and their internal volumes are connected together via a cylindrical connecting wall 4. A piston 5 is arranged inside tube 3. One end of a vertical rod 6 is attached to the piston 5 while its other end engages an eyelet 7. The eyelet is located at one end of one arm of a lever 8, which is rotatably mounted about a horizontal axis 9. The arm of lever 8 which is opposite to the one including the eyelet 7 is in contact with a cam 10 rotatably mounted for rotation about a horizontal axis 11. Contact between lever 8 and cam 10 is provided for by a spring 12, one end of which is rigidly fixed to a fixed point 13 in the vertical plane of rotation of the lever 8, the other end of the spring being fixed to lever 8.

Cam 10 is driven in rotation about the axis 11 by an electric motor 14 via a speed reduction gear 39.

A side port 15, which is located in the lower part of the tube 3, is connected by means of a pipe 16 to a reservoir which contains a liquid substance 18 such as a reagent. A valve 38 is arranged inside the pipe 16.

An enclosure 19 is provided around the calibrated tube 2 and is connected by means of two pipes 20 and 21 to refrigeration unit 22.

Below the tubular part 1, a laser generator 23 is arranged, which may for example be of the type using glass doped with neodymium, which emits a horizontal laser beam 24 on the path of which an optical system is located, such as for example a converging lens 25 which is capable of focussing the energy of beam 24 to a point 26 located on the extension of the vertical axis 27 of the calibrated tube 2.

An light emitting diode 28 powered by a circuit 29 emits a horizontal light beam 30 which cuts the axis 27 at a point 31 arranged at a predetermined distance 32, which can be of the order of 5 millimeters, below point 26. The beam 30 is intercepted beyond point 31 by a photoelectric detector 33, and the electrical output signal from this is connected to a triggering circuit 34, which in its turn is connected to the laser generator 23.

Below the location of point 31, a tubular electrical heater 35 is arranged vertically so as to surround axis 27.

A vessel 36 is placed below the heater 35, sustantially in line with axis 27.

Figure 2:
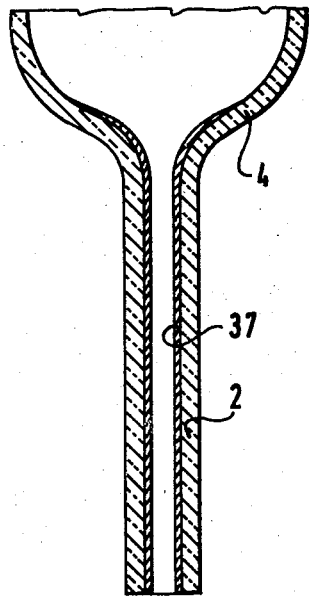
FIG. 2 is a partial view in section and on an enlarged scale of one part of the device shown in FIG. 1.

FIG. 2 is a partial cross-sectional view of the tubular part 1, which shows the calibrated tube 2 on an enlarged scale. In this drawing it is possible to see how the internal cylindrical surface of tube 2 is coated with a layer 37 of a material having a low coefficient of friction such as polytetrafluorethylene, and this layer can extend, as shown, towards the joining wall 4.

The device which has been described above and illustrated in FIGS. 1 and 2 operates in the following manner.

Rotation of the cam 10 causes alternate upwardly and downwardly directed rotation of the lever 8 about its axis 9.

This alternating rotation brings about alternating vertical displacement of piston 5. In the position as shown in FIG. 1, piston 5 is in its lowermost position, slightly above the port 15; the uppermost position of piston 5 is shown in dashed ines at 5', this position corresponding to position 8' of lever 8.

When the piston 5 ascends in the filling tube 3, the liquid substance 18 is drawn via the pipe 16 into the body of tube 3. As soon as piston 5 starts to descend, the liquid substance is pushed into the calibrated tube 2. The valve 38 is provided to prevent any passing back of the substance into the pipe 16 in the direction of reservoir 17.

The circulation of the refrigerating liquid in the enclosure 19 causes intense cooling and the freezing of the substance which occupies the internal volume of tube 2. The temperature of the refrigerating liquid may, for example, be of the order of −20° C.

The degree of cooling is such that, under the influence of the pressure applied downwardly by piston 5 on the upper level of the substance contained in tube 3, a continuous vertical thread 40 of frozen substance is extruded below the calibrated tube 2. Sliding of the thread on the internal wall of tube 2 is aided by the presence of the coating 37.

When the lower end of the thread 40 reaches the light beam 30, a portion of the energy of this beam is diffused or reflected by the thread 40. The amount of illumination falling on detector 33 consequently decreases, which leads to a decrease in the amplitude of the electrical signal delivered by the detector 33. Circuit 34 responds to this decrease in amplitude by providing the control signal for the triggering of a laser impulse. The laser energy which is concentrated at point 26 causes the thread 40 to break at this point. A detached portion of length 32 becomes separated from the thread and falls into the vessel 36. Obviously the internal volume of tube 33 is capable of storing an amount of the substance which is sufficient for a plurality of identical detached portions to be separated successively from thread 40 during one single descent of piston 5. These detached portions are then received respectively in a plurality of vessels, such as the one shown at 36, which are carried by a conveyor which moves transversely with respect to the axis 27.

It should be observed that it is possible to obtain a plurality of detached portions of the same length without making use of the locating device 28–29–33–34. In order to achieve this, the profile of cam 10 can be designed in such a way that the passage of the thread 40 out of the tube 2 occurs at a constant speed whilst at the same time the laser generator 23 can be set up to emit a sequence of laser pulses which are repeated at a constant rate. Under these conditions, when the speed of this passage is known, the rate of emission of pulses from the laser generator is selected so that a detached portion of desired length 32 is obtained.

The very high energy density caused by the concentration of the laser beam makes it possible to make a clean cut through the thread 40 and to obtain a very high degree of accuracy in the length 32 of the detached portion, i.e. in the volume of the measured amount to be dispensed into the vessel. It should be noted that it is possible to increase the accuracy of aportionment to an even greater degree by using a cylindrical lens as the optical focussing system which is arranged so as to concentrate the energy of the beam into a portion which cuts the thread 40 perpendicularly to its axis 27.

When there is no need for such a high degree of accuracy in the amount to be dispensed into the vessel, it is also possible to cut the thread 40 using known mechanical devices, for example using two blades, which are not shown, which are arranged parallel with respect to each other in a horizontal plane at each side of the thread 40, these blades having their displacements controlled in such a way that their sharpened edges meet along a straight line which cuts the axis of thread 40. It is also possible to cut the thread 40 using thermal means for example using a straight conductor wire which is brought to a high temperature by the passage of a current, the wire being displaced in a horizontal plane and cutting the thread 40.

The detached portion of frozen substance which is dispensed into the vessel 36 becomes progressively heated up on contact with the ambient air and after a period of time consequently regains its liquid state.

The heater 35 shown in FIG. 1 makes it possible to reheat the detached portion whilst it is falling, so that the detached portion is then in the liquid state upon its arrival in the vessel 36.

Obviously, such reheating can more generally be obtained using any known thermal means, and in particular by making use of an infrared radiation generator.

It may be absolutely necessary to reheat the detached portion before it arrives in the vessel in the case where the vessel 36 has very small dimensions and the detached portion is relatively long. In this case the whole length of the frozen detached portion cannot be accommodated in the internal volume of the vessel and there is the likelihood that some of the substance will flow outside the vessel as soon as the detached portion starts to heat up.

I claim:

1. Process for dispensing a predetermined amount of a liquid substance into a vessel, said process comprising the following steps:

causing a portion of said substance to pass into a tubular part whose lower portion is calibrated tube which is arranged vertically above the vessel, applying a downwardly directed vertical pressure on the upper surface of the substance which has been taken up in the tubular part, cooling said lower portion of the tubular part sufficiently to form a continuous vertical thread of frozen substance, and under the influence of said pressure, extruding said thread from said calibrated tube bottom, and cutting the thread such that a detached portion of predetermined length which has been removed from the thread falls by gravity into the vessel, whereby said detached portion constitutes, after regaining the liquid state, said predetermined dispensed amount.

2. Process according to claim 1, further comprising heating the detached portion which has been separated from the thread so that it arrives in the liquid state in the vessel.

3. Device for dispensing a predetermined amount of a liquid substance into a vessel, said device comprising a tubular part which is arranged vertically above the vessel, the lower portion of the tubular part comprising a calibrated tube, means for causing a portion of said substance to pass into the tubular part, means for cooling the calibrated tube, means for applying a downwardly directed vertical pressure on the upper surface of the substance received by the tube, simultaneously with said means for cooling in order to extrude a continuous vertical thread of the frozen substance below the calibrated tube, and means for cutting the thread so as to separate a detached portion of thread having a predetermined length, whereby said detached portion is received by gravity in the vessel, constitutes, after regaining the liquid state, said predetermined dispensed amount.

4. Device according to claim 3, further including means for heating the portion detached from the thread, said heating means being arranged on the path of the detached portion between the thread and the vessel.

5. Device according to claim 3, wherein the said means for cutting the thread includes a laser beam generator and an optical system for concentrating this beam onto the thread.

6. Device according to claim 5, wherein said means for cutting the thread so as to detach a portion of predetermined length further includes a generator for a light beam which cuts the axis of the thread at a point located below the region at which the laser beam is concentrated and remote from this region of said predetermined length, photoelectrical detector arranged so as to receive the light beam and a circuit for processing the electrical signal delivered by the detector, said circuit being coupled to said laser generator in order to control the triggering of an impulse from this generator at the point in time where the amplitude of said signal decreases as a result of the lower end of the thread intercepting the light beam.

7. Device according to claim 5, wherein said optical system comprises a cylindrical lens for concentrating the beam into a portion which is perpendicular to the axis of the thread.

8. Device according to claim 3, wherein the internal cylindrical surface of the calibrated tube is coated with a layer of a material which is suitable for easing the sliding of the frozen substance when the said pressure is applied.

9. Device according to claim 3, wherein the said means for cooling comprise an enclosure which surrounds the calibrated tube and means for causing a refrigerated fluid to circulate in this enclosure.

10. Device according to claim 3, wherein the tubular part carries, at its upper portion, a filling tube which is in communication with the calibrated tube and which has an internal diameter which is greater than that of the calibrated tube and wherein said means for causing a portion of the substance to pass into the tubular part includes a piston which slides vertically in the filling tube.

11. Device according to claim 10, wherein said means for applying a vertical pressure on the upper surface of the substance received in the tube comprises means for exerting said pressure onto the piston.

12. Device according to claim 4, wherein the means for heating the detached portion comprise a vertical tubular heater.

13. Device according to claim 4, wherein the means for heating comprise an infrared radiation generator.

* * * * *